United States Patent [19]

Butler

[11] Patent Number: 4,926,797

[45] Date of Patent: May 22, 1990

[54] WOOD BURNING HOT WATER FURNACE

[76] Inventor: Jon E. Butler, 6447 N. 48th St., St. Paul, Minn. 55109

[21] Appl. No.: 312,686

[22] Filed: Feb. 21, 1989

[51] Int. Cl.[5] ..... F22B 5/00

[52] U.S. Cl. ..... 122/15; 110/234; 126/361

[58] Field of Search ..... 122/13 R, 15; 110/234; 126/361

[56] References Cited

U.S. PATENT DOCUMENTS

| | | | |
|---|---|---|---|
| 4,102,279 | 7/1978 | Groschl et al. | 110/234 |
| 4,516,534 | 5/1985 | Jahier | 122/15 |
| 4,562,777 | 1/1986 | van der Voort | 122/15 X |
| 4,724,798 | 2/1988 | Alspaugh | 122/15 |
| 4,836,115 | 6/1989 | MacArthur | 110/234 |

FOREIGN PATENT DOCUMENTS

| | | | |
|---|---|---|---|
| 2592944 | 7/1987 | France | 110/234 |
| 2607288 | 5/1988 | France | 110/234 |

*Primary Examiner*—Edward G. Favors
*Attorney, Agent, or Firm*—John W. Adams

[57] ABSTRACT

A forced air liquid heating furnace which includes a liquid heating jacket or chamber surrounding the combustion chamber and having an exhaust gas discharge passage formed in the bottom of the combustion chamber to produce heat transfer on both sides of the liquid heating jacket formed around the combustion chamber. This furnace provides a compact unit which subjects the liquid to the maximum heat exchange output produced in the combustion chamber while maintaining the bottom sufficiently cool to prevent deterioration thereof from the high temperatures produced in the combustion chamber.

3 Claims, 1 Drawing Sheet

WOOD BURNING HOT WATER FURNACE

BACKGROUND OF THE INVENTION

A great variety of wood burning stoves have been developed over the years and these frequently include large insulated water storage tanks which require substantial inputs of energy to raise the temperature of the water. A number of prior art patents embody the large volume storage tank concept such as:

| PAT. NO. | INVENTOR | ISSUED DATE |
|---|---|---|
| 4,473,351 | Hill | September 25, 1984 |
| 4,413,571 | Hill et al. | November 8, 1983 |
| 4,401,101 | Lunde | August 30, 1983 |
| 4,389,980 | Marcotte et al. | June 28, 1983 |
| 4,360,152 | Schlatter et al. | November 23, 1982 |
| 4,309,965 | Hill | January 12, 1982 |
| 3,916,991 | Trump | November 4, 1975. |

SUMMARY OF THE INVENTION

The present invention embodies a high temperature combustion system which transmits extremely hot combustion gases to a relatively low volume of water circulated through the water jacket. The furnace unit provides a forced combustion air supply system which is transmitted to the fire box containing wood to be burned and which is transmitted through a heat exchange path into the fire box to provide pre-heated combustion air to the fire box. The fire box construction provides an exhaust air distribution plenum at the bottom of the fire box. The hot exhaust gases produced from the burning fuel pass down into the bottom exhaust gas plenum and out through the exhaust passage and stack. As soon as the supply air from the blower reaches the combustion chamber, the intensity of the heat of the exhaust gases from the burning fuel is increased to rapidly heat the water being circulated through the water heating chamber. This is accomplished without destroying the metal used in the construction of the combustion chamber.

The combustion air is provided by a blower and travels upwardly through the combustion air supply passage through a plurality of openings formed in the inner shell to supply a flow of combustion air to the lower portion of the combustion chamber.

A water jacket surrounds the lower portion of the combustion chamber and is formed by two spaced apart bottom panels or plates. A bottom exhaust discharge passage extends downwardly from the combustion chamber through the space between the two bottom panels to discharge the exhaust gases downwardly into the exhaust plenum below the water jacket in heat exchange relation to the jacket.

DETAILED DESCRIPTION OF THE DRAWINGS

Figure 1:
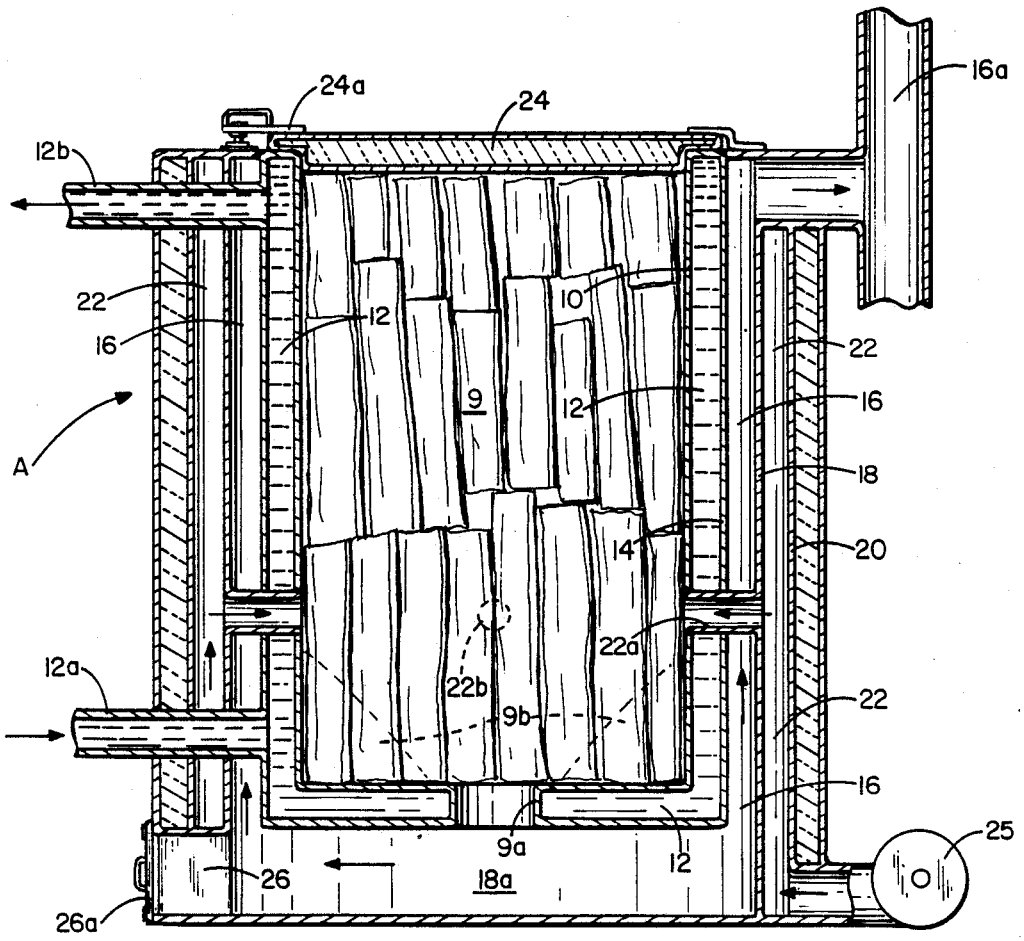

FIG. 1 is a central vertical sectional view through a furnace embodying this invention.

DETAILED DESCRIPTION OF THE PREFERRED EMBODIMENT

The furnace shown in FIG. 1 is designated as an entirety by the letter A. The furnace illustrated is a generally cylindrical unit having a combustion chamber 9 within a cylindrical inner shell 10. A water heating jacket or chamber 12 surrounds the inner shell 10 and is defined by an outer chamber wall 14 spaced from the inner shell 10 and surrounding the same. An annular exhaust gas passage 16 surrounds the wall 14 and is defined on the outside by a generally cylindrical exhaust passage wall 18. Insulation 20 is provided around the outer wall 18. An annular combustion air passage 22 surrounds the exhaust chamber wall 18 and communicates with the inner combustion chamber 9 through a plurality of vent conduits **22*a* and inner openings 22*b***.

The combustion gases from chamber 9 are forced downwardly through a central exhaust discharge passage **9*a* into a bottom exhaust gas plenum 18*a* communicating with the bottom of the annular exhaust gas passage 16**.

An insulated hinged cover 24 is provided to close the top of the combustion chamber 9 and has a pivoted latch **24*a*. A blower 25 supplies air into the combustion chamber 9 through the annular passage 22 and openings 22*b*. The water to be heated is circulated through the chamber 12 by a suitable pump (not shown) and travels from inlet 12*a* up through the chamber 12 and out through the discharge 12*b* into conventional heat exchangers within the building environment to be heated (not shown). A clean-out opening 26 communicates with the exhaust chamber plenum 18*a* and is provided with an access door 26*a* to permit any ash accumulation to be removed from plenum 18*a*. The exhaust gases pass upwardly through the annular passage 16 and out through the stack 16*a*** to the atmosphere.

The temperatures produced within the lower portion of the combustion chamber where the combustion air enters the chamber reaches 1500 to 2000 F. The extremely hot exhaust gases pass directly from the hottest area of the combustion chamber downwardly through the exhaust passage **9*a* in the bottom of the chamber so that the area of the water jacket in the bottom of the furnace is subjected to maximum heat on both sides thereof to provide almost instantaneous heat response in the water supply and the environment to be heated. Ash from the wood being burned builds up an agglomerated semi-solid mass in the form of an inverted conical ash residue 9*b* around and the central discharge opening. This inverted conical ash residue mass forms an insulating cone which protects the lower inside wall of the furnace below the air inlet openings in the same way that refractory brick might protect a furnace wall and eliminates the need for the use of such refractory material in the bottom of the furnace. Due to the intensity of the heat, very little ash is actually produced from the wood being burned and the hottest gaseous products of combustion travel downwardly through the exhaust discharge passage 9*a* into the plenum 18*a* thus exposing both sides of the bottom of the water jacket to maximum heat during operation of the blower. The intense heat within the combustion chamber 9** dries out the wood supply located in the top of the chamber so that ever green or wet pieces of wood can be used effectively in the furnace unit. As soon as the blower is shut off either manually or by a thermostat (not shown) in the controlled environment, the limited air supply reduces the combustion level so that the wood supply is preserved for 18 to 20 hours in a furnace unit smaller than 3 feet in diameter by 4 feet in height. Also, the furnace can be shut off for 15 to 18 hours and still retain sufficient sparks to ignite when the forced combustion air is provided when the blower is turned back on.

This invention provides a relatively compact yet highly efficient wood burning water heating furnace which eliminates the need for a large volume heat storage tank and which is designed to produce extremely high temperatures with only a minimum of residue ash.

What is claimed is:

1. A forced air liquid heating furnace comprising, a combustion chamber, having side walls, a bottom and a removable top closure, a liquid heating chamber surrounding portions of the combustion chamber in heat exchange relation thereto, an exhaust gas plenum below the combustion chamber, an exhaust gas discharge passage in the bottom of the combustion chamber delivering the combustion gases downwardly into the plenum, an annular exhaust gas passage surrounding the liquid heating chamber and receiving the exhaust gases from the plenum, a vent stack communicating with the upper end of the annular exhaust gas passage to discharge the exhaust gases from the combustion chamber into the atmosphere, and a blower delivering combustion air into the lower portion of the combustion chamber to produce an air flow downwardly within said chamber through the bottom exhaust gas passage in the bottom of the chamber, and wherein the liquid heating chamber underlies the bottom of the combustion chamber in heat exchange relation to both the plenum and the combustion chamber.

2. A forced air liquid heating furnace comprising, an inner combustion chamber having a bottom, sidewalls and a removable top closure, a water jacket surrounding the side walls and the bottom of said combustion chamber in heat exchange relation thereto and having an exhaust gas passage therethrough in the bottom of the combustion chamber, an exhaust gas passage surrounding the water jacket and transferring heat inwardly to the water therein, an exhaust gas plenum disposed below the bottom of the water jacket in heat exchange relation thereto and communicating at the outer edge portions thereof with the exhaust gas passage to deliver the exhaust gases from said combustion chamber thereto, an exhaust gas discharge opening in the bottom of the combustion chamber to deliver combustion gases downwardly from the combustion chamber into said plenum, a vent stack communicating with the upper end of the exhaust gas passage to discharge the exhaust gases from the combustion chamber into the atmosphere, and a blower delivering combustion air into the combustion chamber in spaced relation above the bottom thereof, to produce a flow of air and combustion gases downwardly through the opening in bottom of the combustion chamber and outwardly through the exhaust gas plenum, exhaust gas passage and vent stack, and wherein the water jacket extends from the bottom to the top of the combustion chamber, the exhaust gas passage extends from the bottom plenum to the top of the water jacket in heat transfer relationship thereto, and the combustion air passage surrounds the exhaust gas passage and extends substantially the full length thereof.

3. The structure set forth in claim 2 and insulation surrounding the combustion air supply passage to limit the heat transfer outwardly of the air supply passage.

* * * * *